US005527653A

United States Patent [19]

Tanaka

[11] Patent Number: 5,527,653

[45] Date of Patent: Jun. 18, 1996

[54] ELECTROPHOTOGRAPHIC PHOTOSENSITIVE MEMBER, PROCESS CARTRIDGE AND ELECTROPHOTOGRAPHIC APPARATUS WHICH EMPLOY THE SAME

[75] Inventor: Masato Tanaka, Kawasaki, Japan

[73] Assignee: Canon Kabushiki Kaisha, Tokyo, Japan

[21] Appl. No.: 314,768

[22] Filed: Sep. 29, 1994

[30] Foreign Application Priority Data

Oct. 4, 1993 [JP] Japan ..... 5-269423

[51] Int. Cl.[6] ..... G03G 5/06; G03G 15/04

[52] U.S. Cl. ..... 430/58; 430/72; 430/78; 430/79; 355/211

[58] Field of Search ..... 430/72, 78, 58, 430/79; 355/211

[56] References Cited

U.S. PATENT DOCUMENTS

| | | | |
|---|---|---|---|
| 3,615,412 | 10/1971 | Hessel | 430/72 |
| 5,077,164 | 12/1991 | Ueda et al. | 430/78 |

FOREIGN PATENT DOCUMENTS

| | | |
|---|---|---|
| 0480821 | 4/1992 | European Pat. Off. . |
| 54-22834 | 2/1979 | Japan . |
| 58-177955 | 10/1983 | Japan . |
| 58-194035 | 11/1983 | Japan . |
| 58-215556 | 9/1986 | Japan . |
| 61-241763 | 10/1986 | Japan . |
| 63-17456 | 1/1988 | Japan . |
| 63-259572 | 10/1988 | Japan . |
| 63-259670 | 10/1988 | Japan . |
| 1-197759 | 8/1989 | Japan . |

OTHER PUBLICATIONS

Patent Abstracts of Japan, vol. 8, No. 129 (P–280) (1566), Jun. 15, 1984.

*Primary Examiner*—Christopher D. Rodee

*Attorney, Agent, or Firm*—Fitzpatrick, Cella, Harper & Scinto

[57] ABSTRACT

An electrophotographic photosensitive member includes a conductive substrate and a photosensitive layer thereon. The photosensitive layer contains a disazo pigment having a 1,2-benzofluorenone as a central structure. A process cartridge and an electrophotographic apparatus containing the electrophotographic photosensitive member is also provided.

In a preferred embodiment the disazo pigment has the formula (I) as follows:

formula (1):

(1)

10 Claims, 1 Drawing Sheet

ELECTROPHOTOGRAPHIC PHOTOSENSITIVE MEMBER, PROCESS CARTRIDGE AND ELECTROPHOTOGRAPHIC APPARATUS WHICH EMPLOY THE SAME

BACKGROUND OF THE INVENTION

1. Field of the Invention

The present invention relates to an electrophotographic photosensitive member, and more particularly, to an electrophotographic photosensitive member having a photosensitive layer in which a disazo pigment having a specific structure is present. The present invention also pertains to a process cartridge and an electrophotographic apparatus which employ such an electrophotographic photosensitive member.

2. Description of the Related Art

Electrophotographic photosensitive members employing organic photoconductive substances have advantages in that productivity is extremely high, that they are relatively inexpensive, and that color sensitivity thereof can be desirably controlled by adequately selecting the pigment or dye used. Therefore, research has heretofore been conducted on electrophotographic photosensitive members. The function separation type photosensitive member has been developed in which a charge generating layer containing an organic photoconductive substance, such as an organic photoconductive dye or pigment, and a charge transporting layer containing a charge transporting substance, such as a photoconductive polymer or a low-molecular organic photoconductive substance, are disposed as a laminate. Accordingly, the sensitivity and durability of the conventional organic photoelectric photosensitive members have thus been improved greatly.

Among organic photoconductive substances, azo pigments in general exhibit excellent photoconductivity. Furthermore, compounds exhibiting desired characteristics can be produced relatively easily by combining amine components with coupler components. Therefore, various types of compounds have heretofore been proposed in, for example, Japanese Patent Laid-Open Nos. Sho 54-22834, Sho 58-177955, Sho 58-194035, Sho 61-215556, Sho 61-241763, Sho 63-17456, Sho 63-259572 and Sho 63-259670.

In recent years, there have been demands for a higher image quality and a higher durability. To meet these demands, electrophotographic photosensitive members having higher sensitivity and exhibiting more excellent electrophotographic characteristics when used repetitively have been desired.

SUMMARY OF THE INVENTION

An object of the present invention is to provide an electrophotographic member having a high sensitivity. Another object of the present invention is to provide an electrophotographic photosensitive member which maintains stable and excellent potential characteristics even when it is used repetitively.

Still another object of the present invention is to provide a process cartridge and an electrophotographic photosensitive apparatus which have the above-described electrophotographic photosensitive member.

According to a first aspect of the present invention, the present invention provides an electrophotographic photosensitive member which comprises a conductive substrate and a photosensitive member thereon. The photosensitive member contains a disazo pigment having a 1,2-benzofluorenone as a central structure.

According to a second aspect of the present invention, a process cartridge, comprising: an electrophotographic photosensitive member and at least one means selected from the group consisting of charging means, developing means and cleaning means;

the electrophotographic photosensitive member comprises a conductive substrate and a photosensitive layer thereon; the photosensitive layer contains a disazo pigment having a 1,2-benzofluorenone as a central structure;

the electrophotographic photosensitive member and the at least one means are supported as a single unit which is detachably mounted on an electrophotographic apparatus body.

According to a third aspect of the present invention, an electrophotographic apparatus, comprising: an electrophotographic photosensitive member, a charging means, an image exposure means, a developing means and a transfer means:

the electrophotographic photosensitive member comprises a conductive substrate and a photosensitive layer thereon; the photosensitive layer contains a disazo pigment having a 1,2-benzofluorenone as a central structure;

DETAILED DESCRIPTION OF THE PREFERRED EMBODIMENTS

Figure 1:
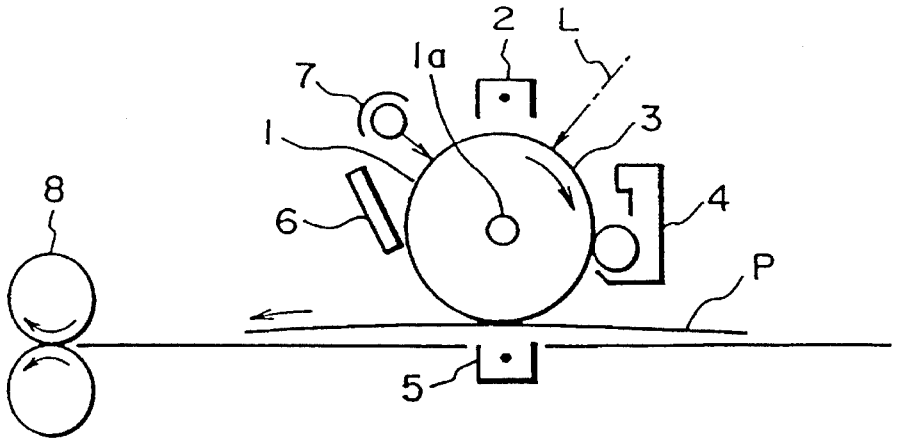
FIG. 1 is a schematic view of an electrophotographic photosensitive apparatus having an electrophotographic photosensitive member according to the present invention.

The electrophotographic photosensitive member according to the present invention has a photosensitive layer which contains a disazo pigment having a 1,2-benzofluorenone as a central structure.

The disazo pigment having the following formula (1) is preferably employed in the present invention:

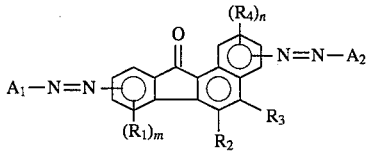

(1)

wherein $A_1$ and $A_2$ are-the same or different and are each a coupler residue having a phenolic hydroxyl group, $R_1$, $R_2$, $R_3$, and $R_4$ are the same or different and are each a hydrogen atom, a halogen atom, an alkyl group or an alkoxy group, and m and n represent 1, 2 or 3.

Examples of halogen atoms represented by $R_1$ to $R_4$ include fluorine atom, chloride atom and bromine atom. Examples of alkyl groups include methyl group, ethyl group and propyl group. Examples of alkoxy groups include methoxy group, ethoxy group and propoxy group. In the present invention, preferably $R_1$ to $R_4$ are each a hydrogen atom.

Desirable examples of the coupler residue represented by $A_1$ and $A_2$ are represented by the following formulas (2) to (7).

(2)

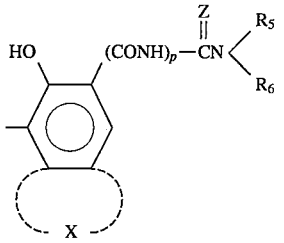

(3)

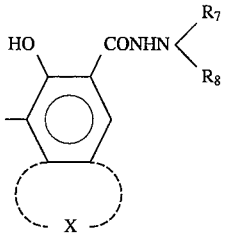

(4)

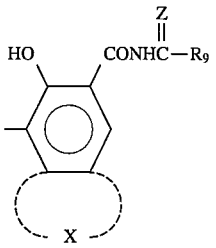

(5)

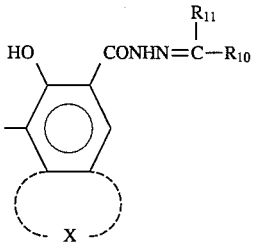

(6)

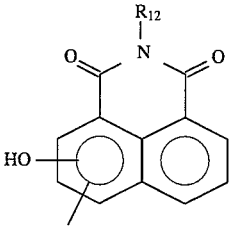

(7)

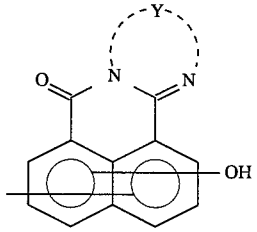

X in formulas (2), (3), (4) and (5) represents a residue which forms, with a benzene ring, either a polycyclic aromatic ring, such as a naphthalene ring or an anthracene ring, or a heterocyclic ring, such as a carbazole ring, a benzocarbazole ring or a dibenzocarbazole ring.

Y in formula (7) represents an arylene group or a bivalent heterocyclic group having a nitrogen atom in its ring. Examples of Such groups include an o-phenylene group, an o-naphthylene group, a perinaphthylene group, a 1,2-anthrylene group, a 3,4-pyrazoldiyl group, a 2,3 -pyridinediyl group, a 4,5-pyridinediyl group, a 6,7 -indazolediyl group and a 6,7-quinolinediyl group.

$R_5$, $R_6$, $R_7$ and $R_8$ in formulas (2) and (3) represent a hydrogen atom, an alkyl group, an aryl group, an aralkyl group or a polycyclic group. $R_5$ and $R_6$, and $R_7$ and $R_8$ may be bonded to form a cyclic amino group having a nitrogen atom in its ring.

$R_9$, $R_{10}$ and $R_{11}$ in formulas (4) and (5) represent a hydrogen atom, an alkyl group, an aryl group, an aralkyl group and a heterocyclic group.

$R_{12}$ in formula (6) represents an alkyl group, an aryl group, an aralkyl group and a heterocyclic group.

The above-described alkyl group may be a methyl, ethyl or propyl group. The aryl group may be a phenyl, naphthyl or anthryl group. The aralkyl group may be a benzyl or phenethyl group. The heterocyclic group may be a pyridyl, thienyl, thiazolyl, carbazolyl, benzoimidazolyl or benzothiazolyl group. The cyclic amino group having a nitrogen atom in its ring may be a pyrolyl, indolyl, indolinyl, carbazolyl, imidazolyl, benzimidazolyl, pyrazolyl, phenothiazinyl, or phenoxazinyl group.

X, Y, $R_5$ to $R_{12}$ may be substituted or unsubstituted. Examples of the substituents include: an alkyl group, such as a methyl group, an ethyl group or a propyl group; alkoxy group, such as a methoxy group, an ethoxy group or a propoxy group; a halogen atom, such as a fluorine atom, a chlorine atom, a bromine atom or an iodine atom; an acyl group, such as an acetyl group or a benzoyl group; an alkylamino group, such as a dimethylamino group or a diethylamino group; a phenylcarbamoyl group; a nitro group; a cyano group; and a halomethyl group, such as a trifluoromethyl group.

Z in formulas (2) and (4) represent an oxygen or sulfur atom.

p in formula (2) is 0 or 1.

Among the disazo pigments employed in the present invention, a disazo pigment, in which $A_1$ and $A_2$ are represented by a formula selected from the group consisting of formulas (2), (3), (4) and (5) and in which X represents a coupler residue forming a benzocarbanole ring with a benzene ring, is particularly desirable as the charge generating material for semiconductor layers because its sensitivity area includes a near infrared region.

Desirable non-limiting examples of the disazo pigment represented by formula (1) of the present invention are shown below.

In the following disazo pigment examples, the basic structures are shown first, followed by the structures of the components $A_1$ and $A_2$.

Basic Structure (1)

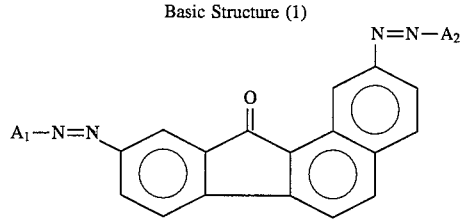

Pigment Example 1
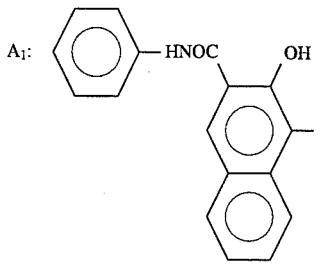
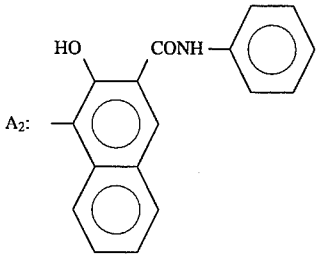
Pigment Example 2
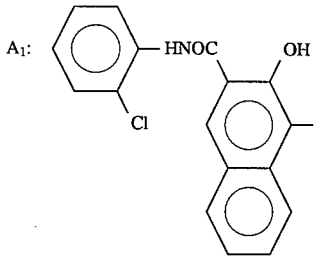
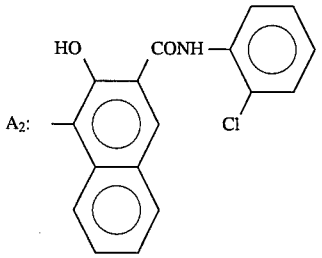
Pigment Example 3
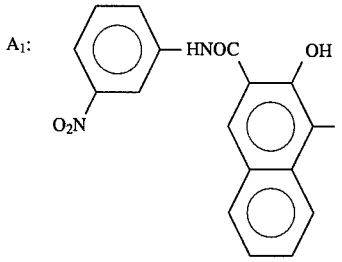
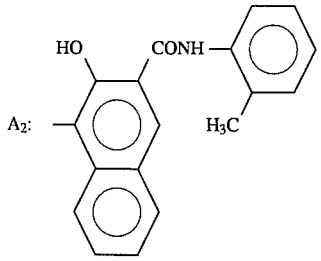
Pigment Example 4
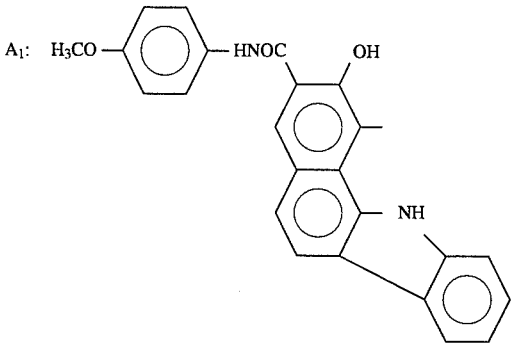
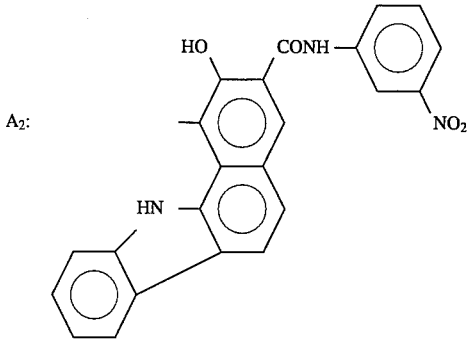
Pigment Example 5
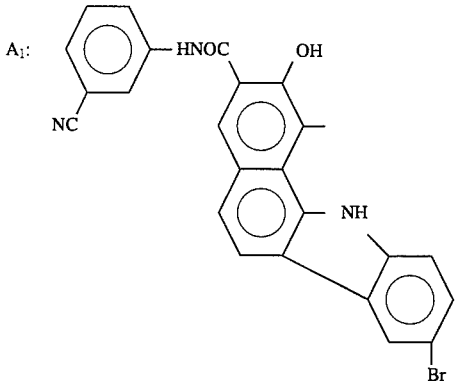

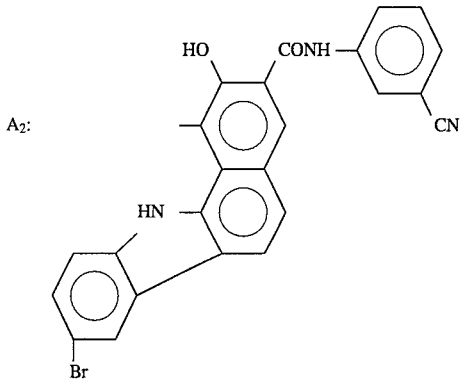
Pigment Example 6
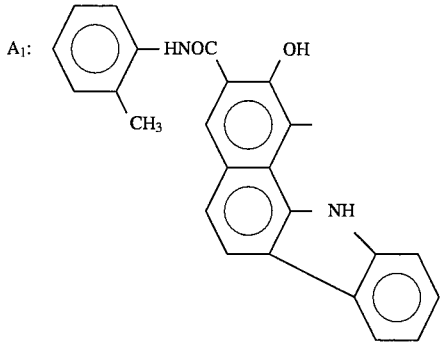
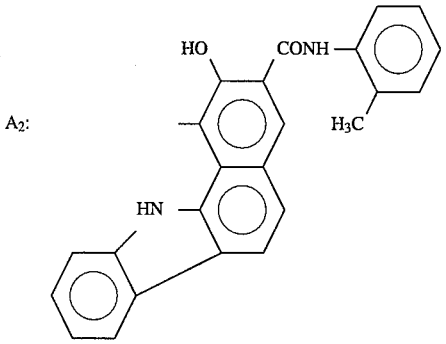
Pigment Example 7
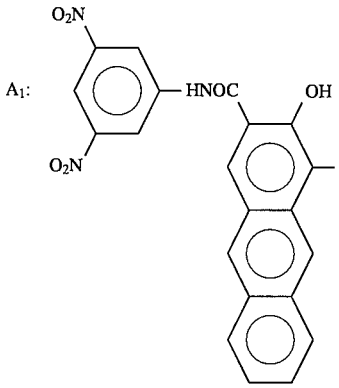
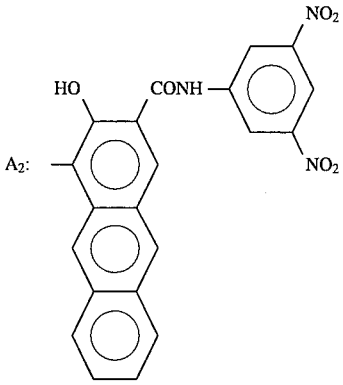
Pigment Example 8
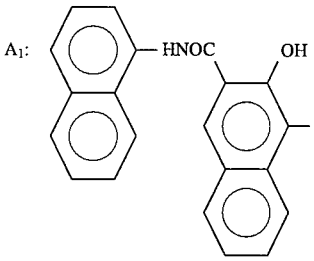
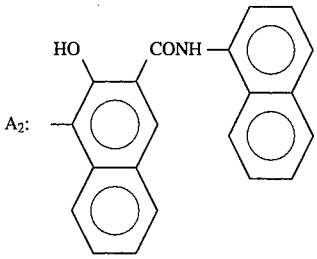
Pigment Example 9
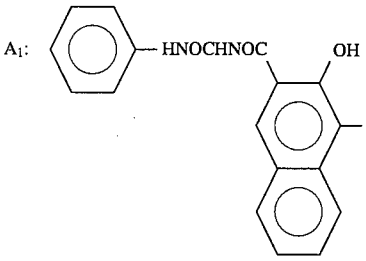
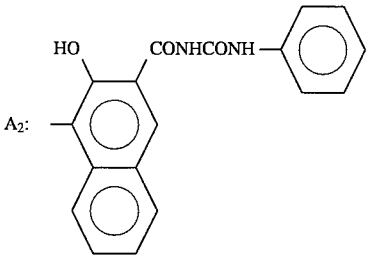

Pigment Example 10
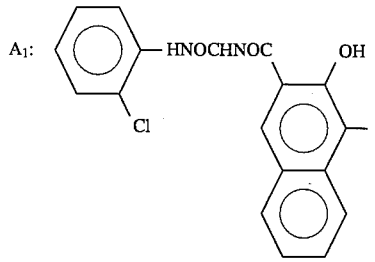
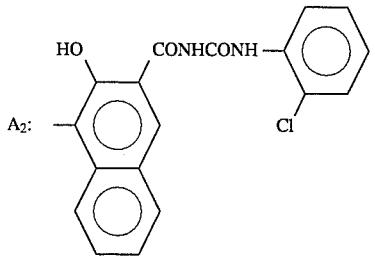
Pigment Example 11
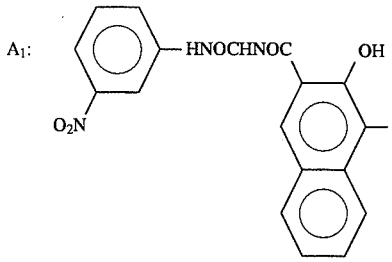
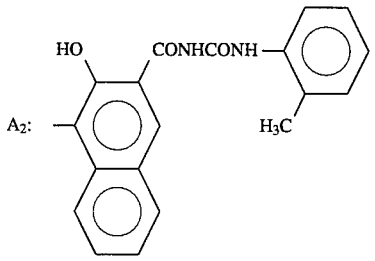
Pigment Example 12
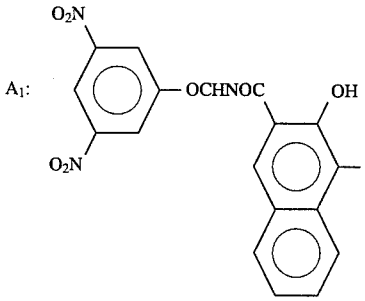
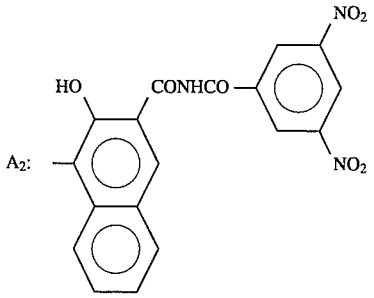
Pigment Example 13
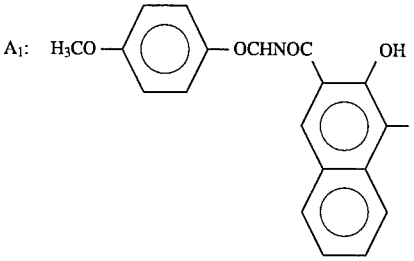
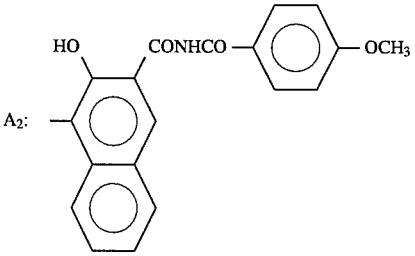
Pigment Example 14
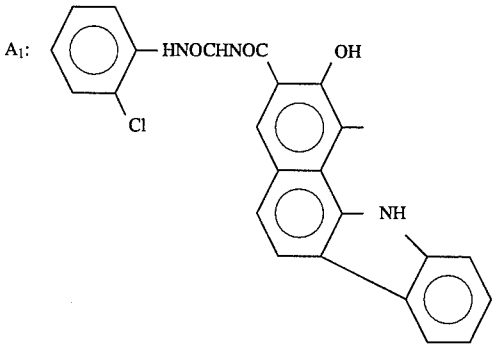
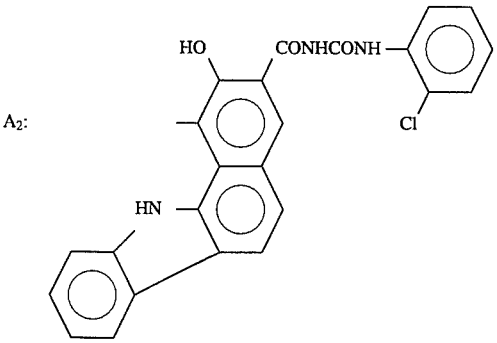

Pigment Example 15
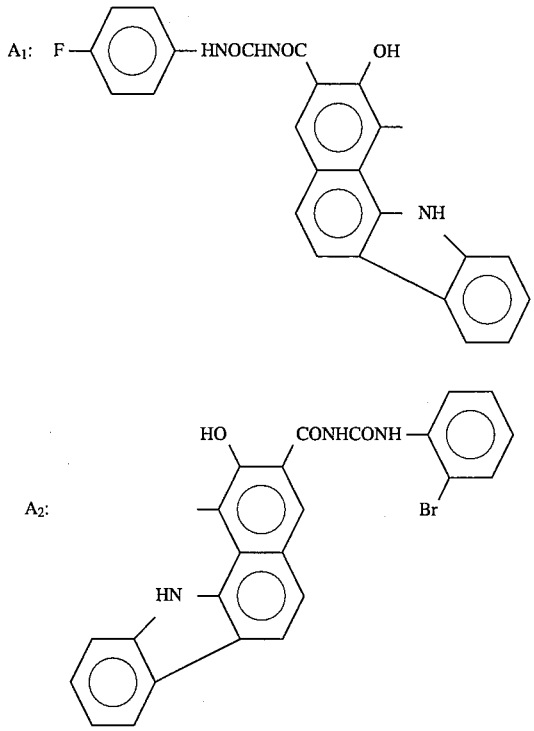
Pigment Example 16
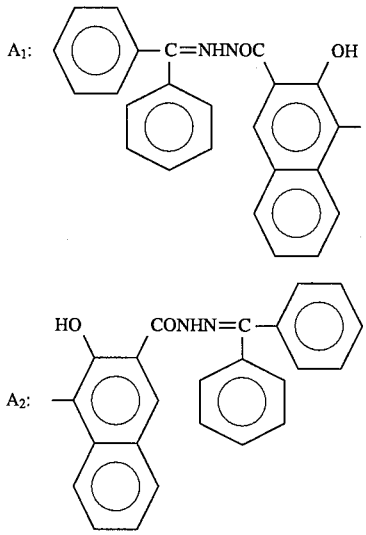
Pigment Example 17
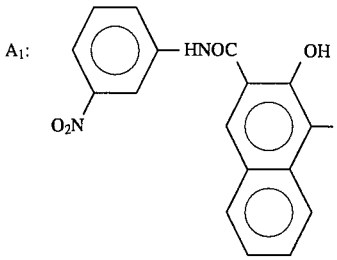
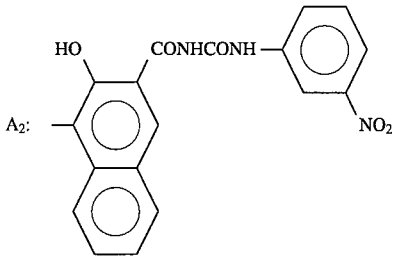
Pigment Example 18
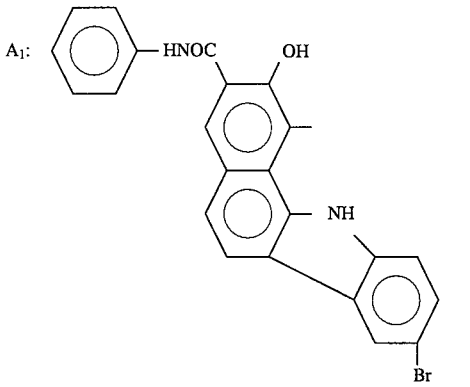
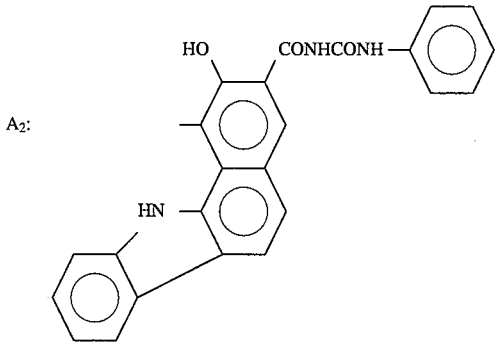
Pigment Example 19
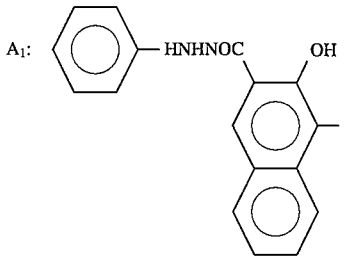
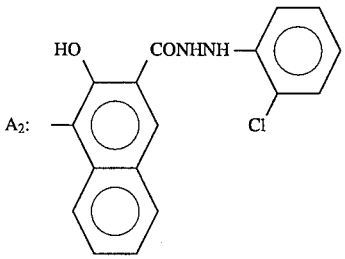

Pigment Example 20
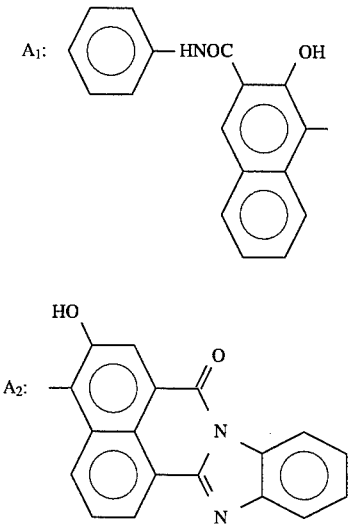
Pigment Example 21
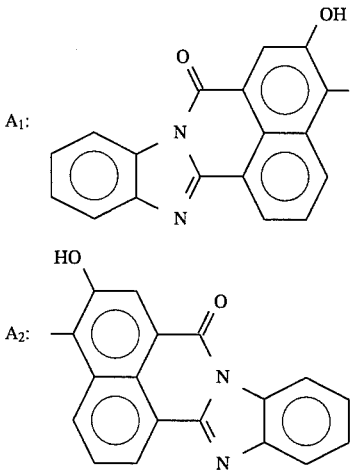
Pigment Example 22
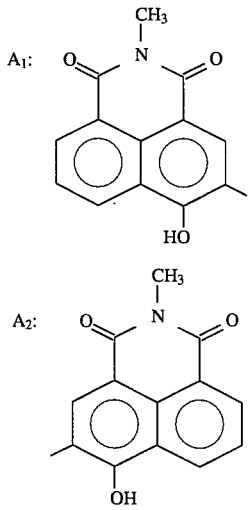
Basic Structure (2)
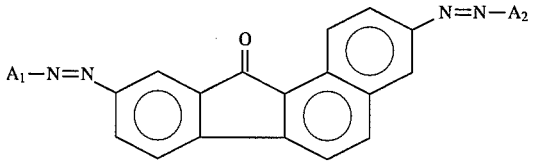
Pigment Example 23
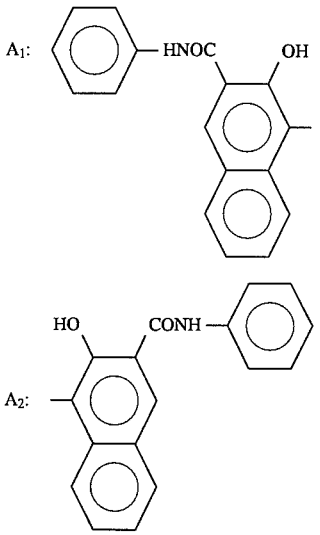
Pigment Example 24
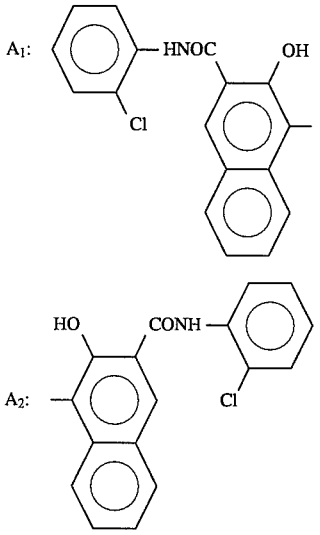
Pigment Example 25
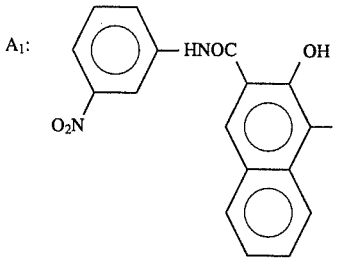

-continued
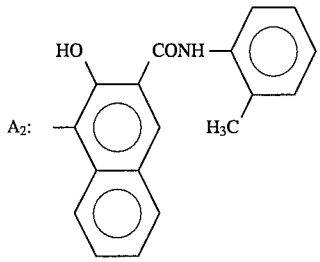
Pigment Example 26
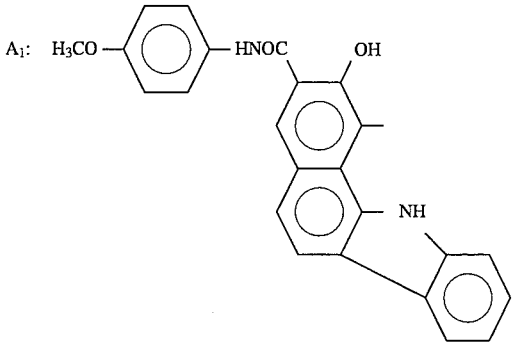
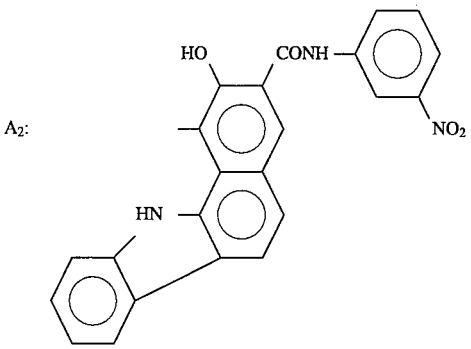
Pigment Example 27
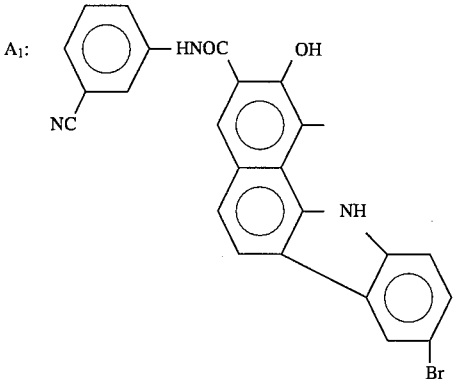
-continued
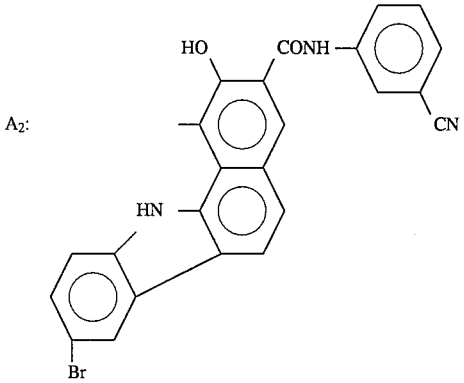
Pigment Example 28
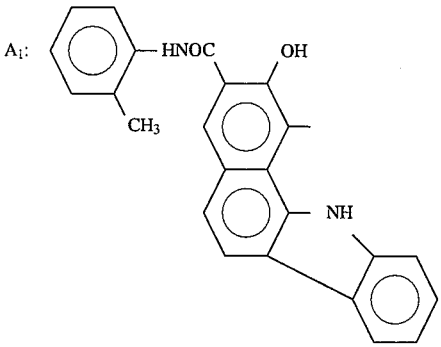
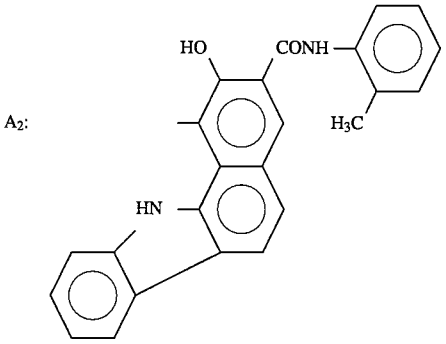
Pigment Example 29
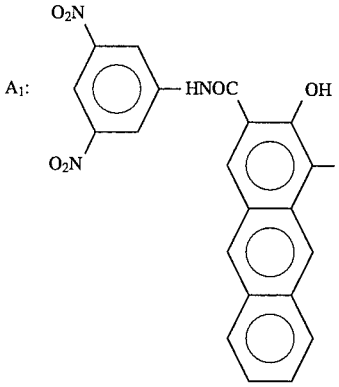

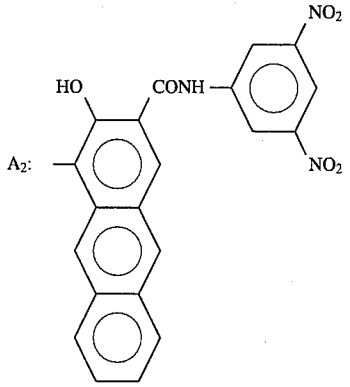
Pigment Example 30
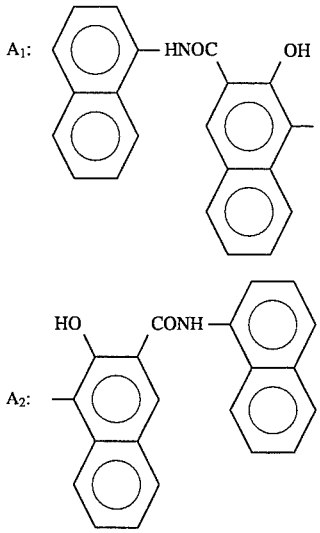
Pigment Example 31
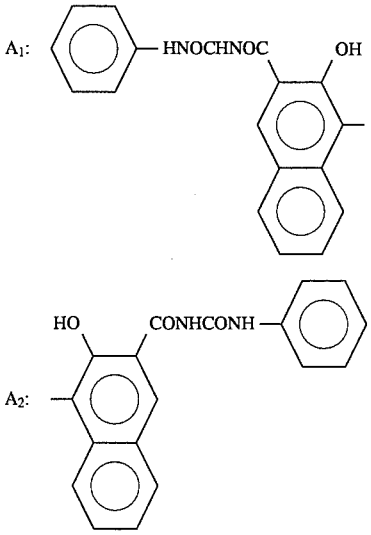
Pigment Example 32
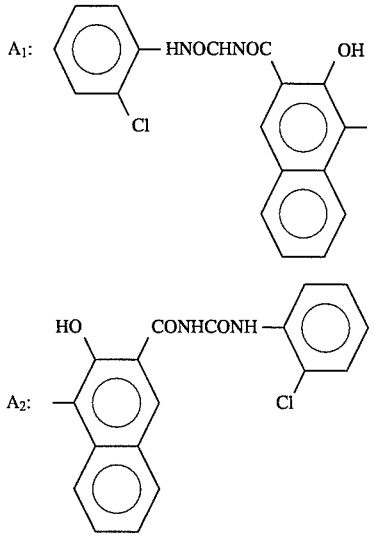
Pigment Example 33
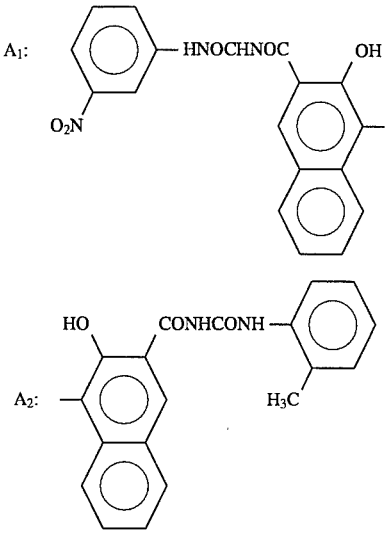
Pigment Example 34
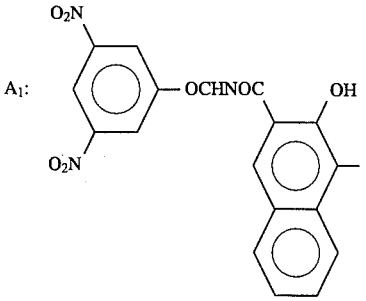

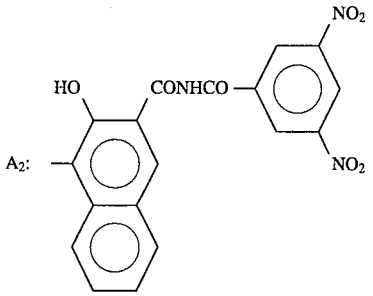
Pigment Example 35
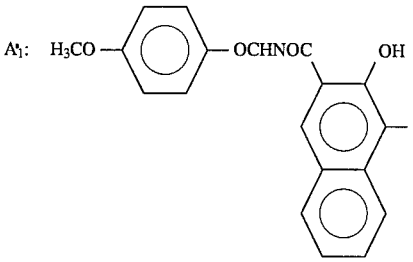
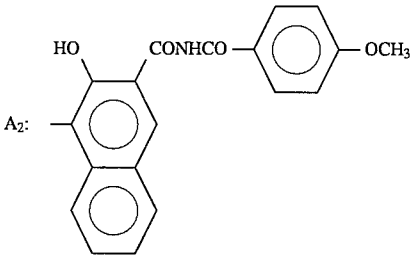
Pigment Example 36
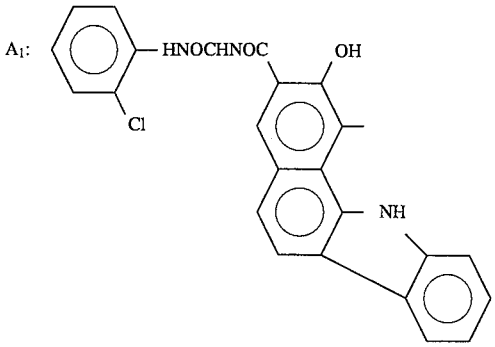
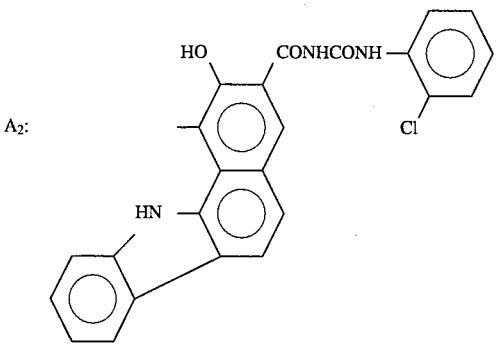
Pigment Example 37
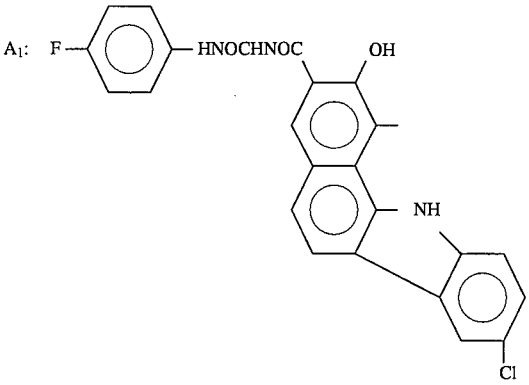
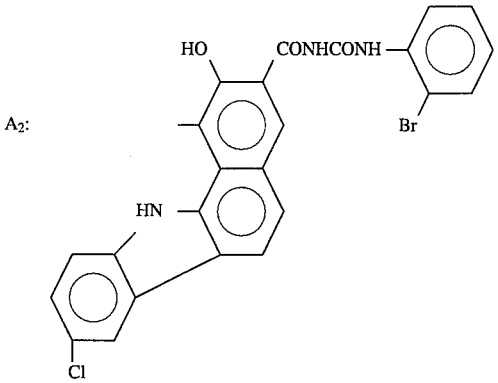
Pigment Example 38
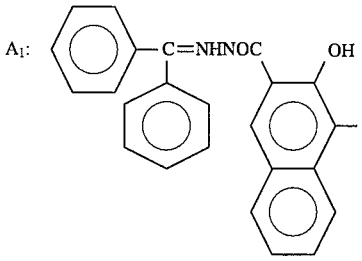
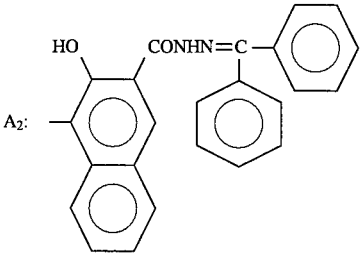

Pigment Example 39
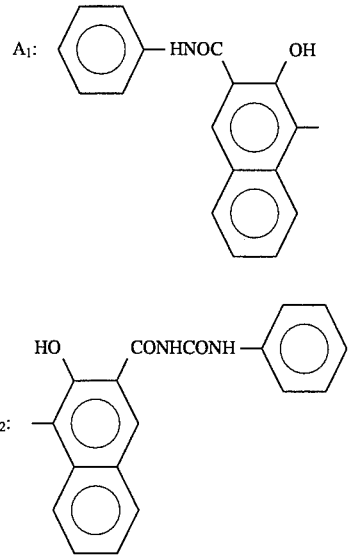
Pigment Example 40
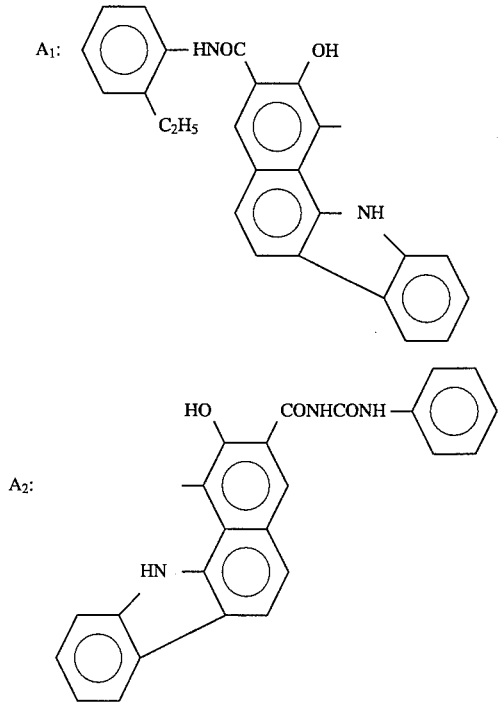
Pigment Example 41
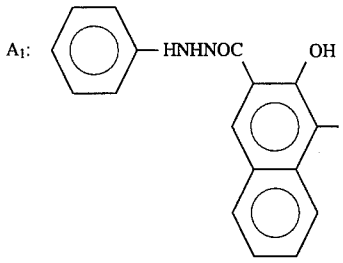
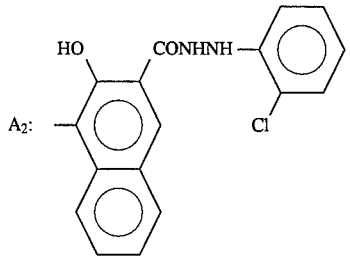
Pigment Example 42
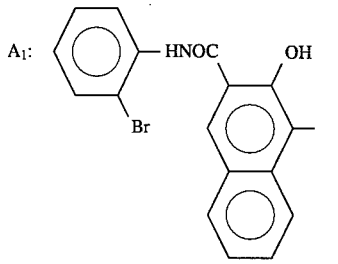
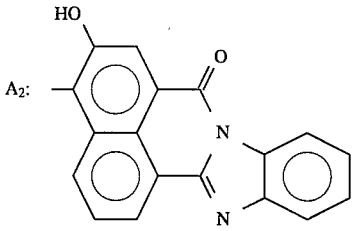
Pigment Example 43
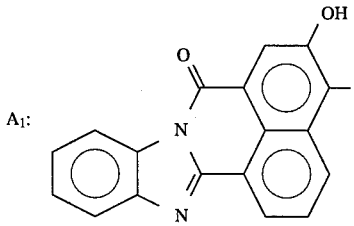
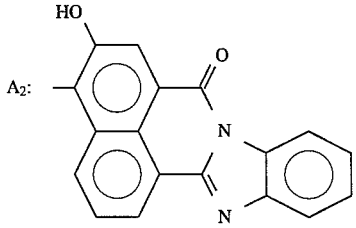
Pigment Example 44
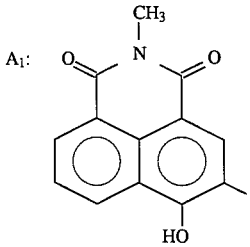

$A_2$:
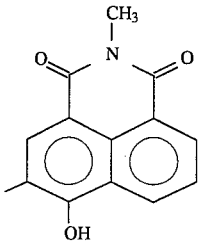
Basic Structure (3)
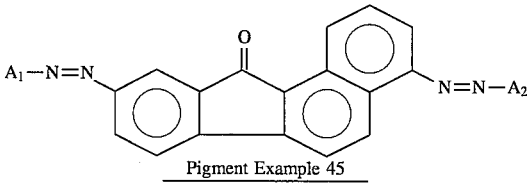
Pigment Example 45
$A_1$:
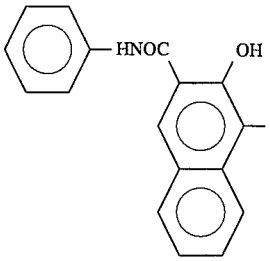
$A_2$:
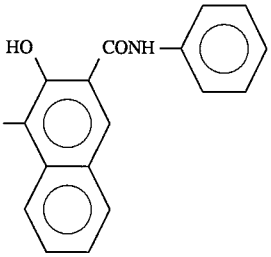
Pigment Example 46
$A_1$:
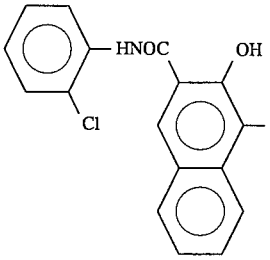
$A_2$:
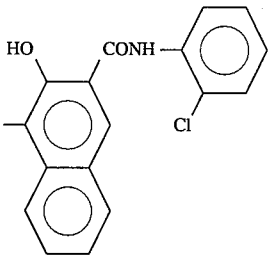
Pigment Example 47
$A_1$:
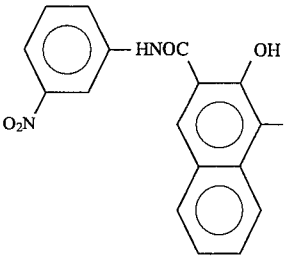
$A_2$:
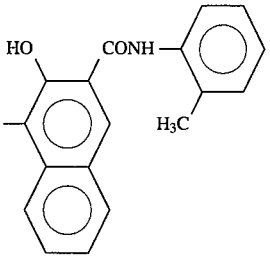
Pigment Example 48
$A_1$:
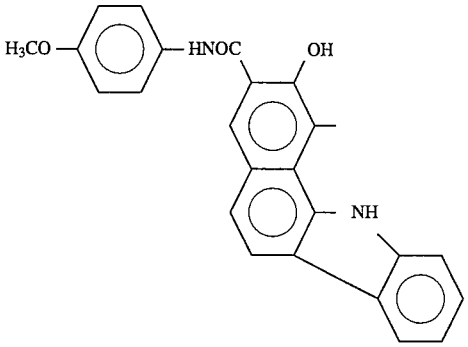
$A_2$:
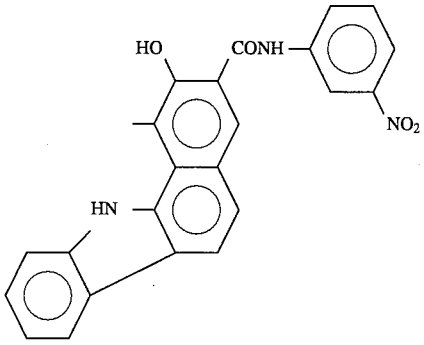

Pigment Example 49
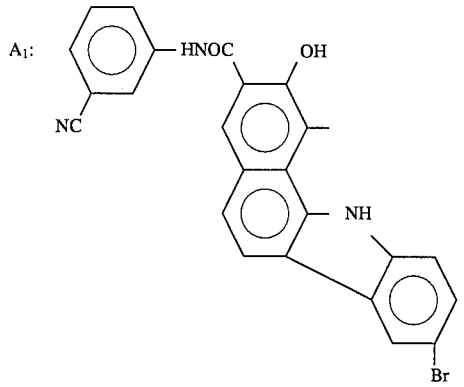
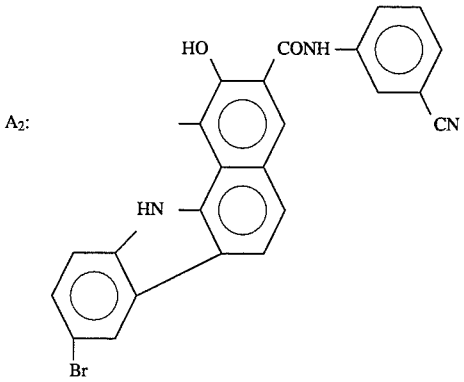
Pigment Example 50
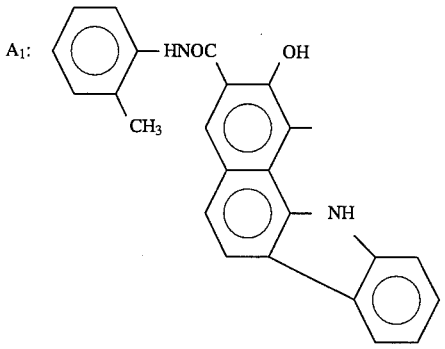
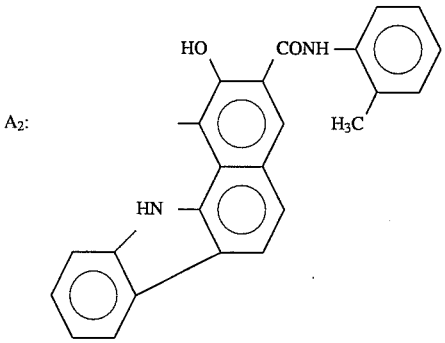
Pigment Example 51
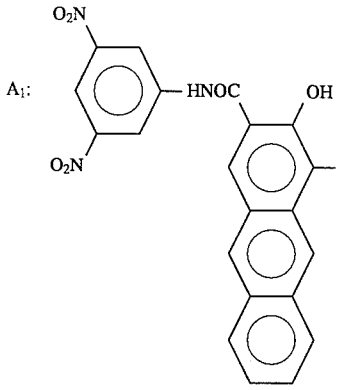
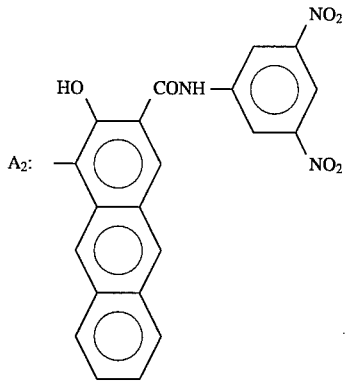
Pigment Example 52
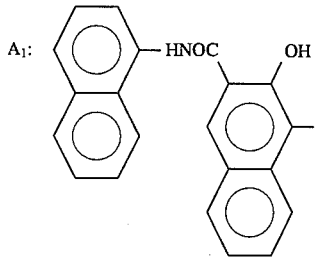
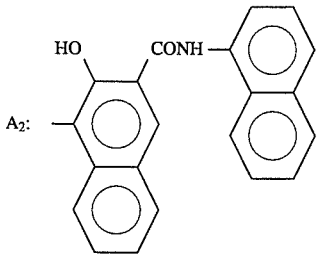

Pigment Example 53
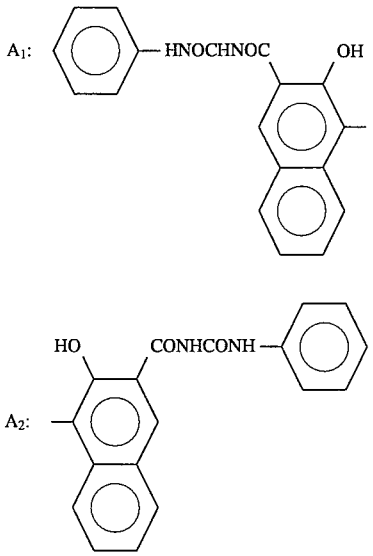
Pigment Example 54
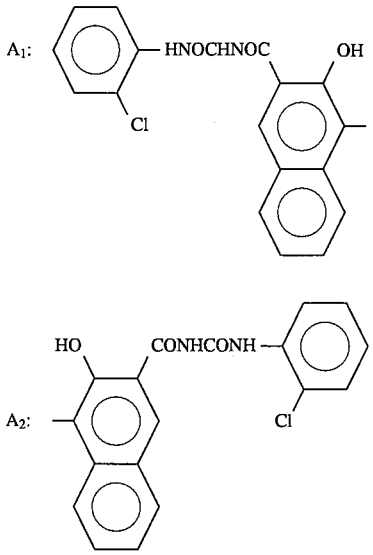
Pigment Example 55
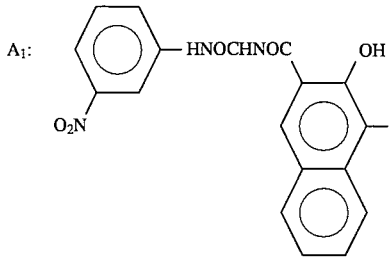
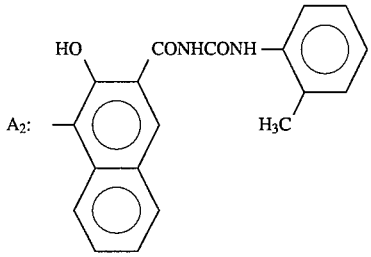
Pigment Example 56
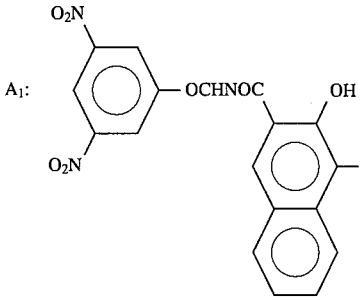
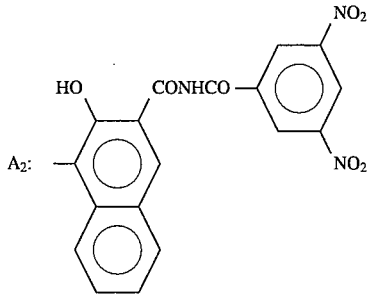
Pigment Example 57
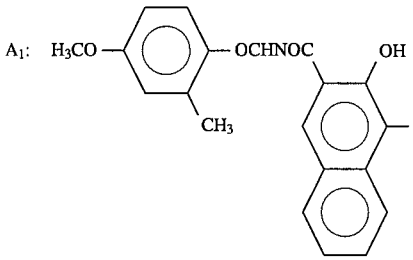
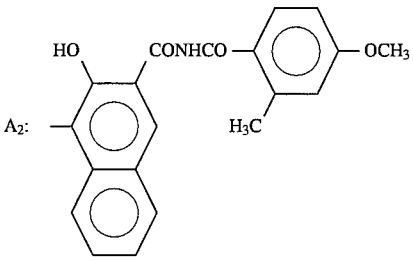

Pigment Example 58
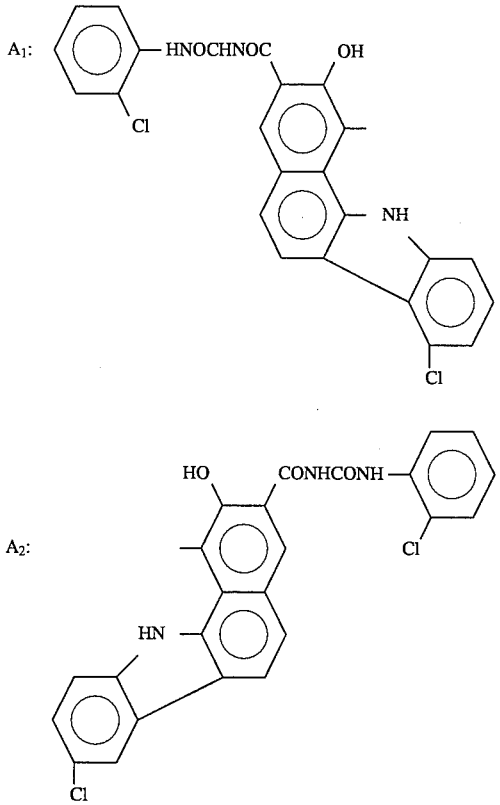
Pigment Example 59
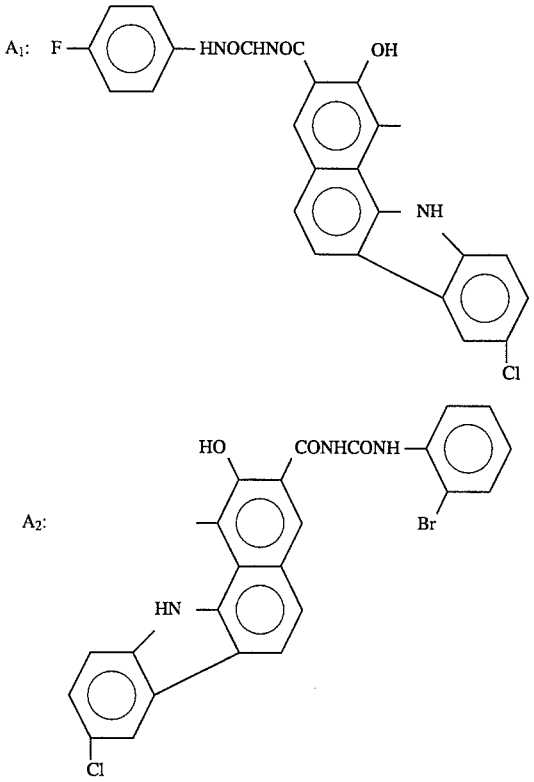
Pigment Example 60
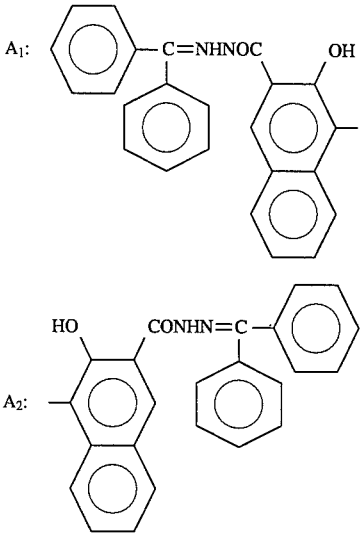
Pigment Example 61
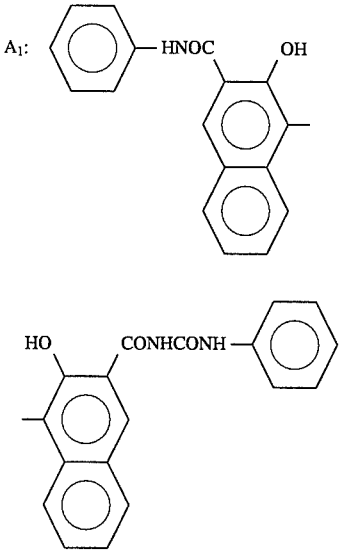
Pigment Example 62
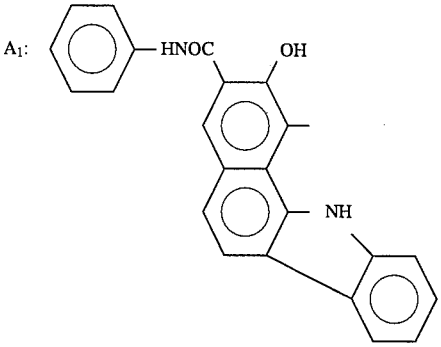

$A_2$:

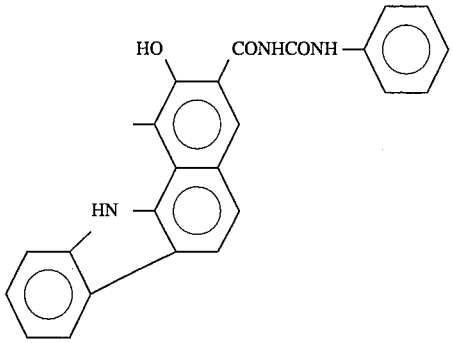

Pigment Example 63

$A_1$:

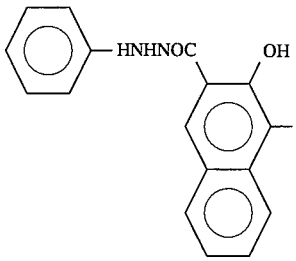

$A_2$:

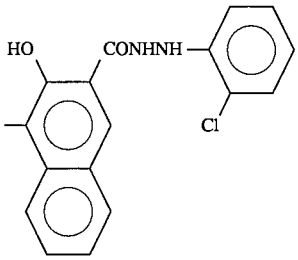

Pigment Example 64

$A_1$:

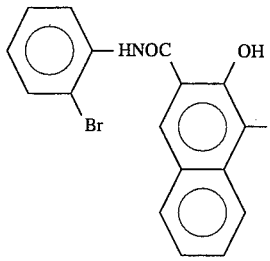

$A_2$:

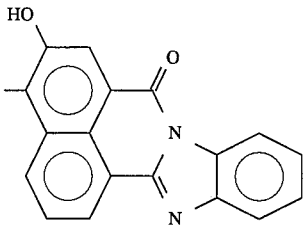

Pigment Example 65

$A_1$:

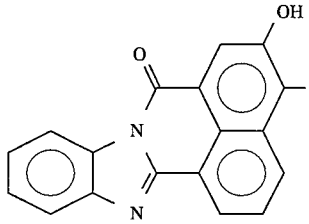

$A_2$:

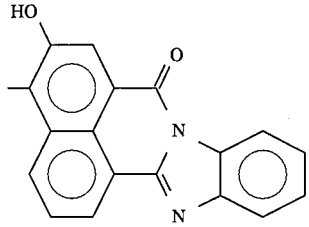

Pigment Example 66

$A_1$:

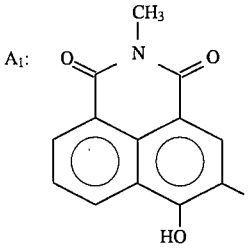

$A_2$:

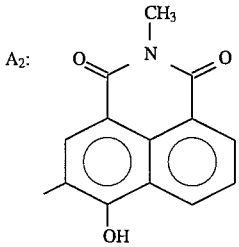

The disazo pigment expressed by formula (1) can easily be synthesized by changing a corresponding diamine into a tetrazonium salt by a normal method and then by coupling the tetrazonium salt to a coupler in an aqueous solution in the presence of an alkali. Alternatively, the disazo pigment can be formed by converting a tetrazonium salt into a borofluoride salt or a zinc chloride complex salt and then by coupling it to a coupler in an organic solution, such as N, N-dimethylformamide or dimethylsulfoxide, in the presence of a base, such as sodium acetate, triethylamine or N-methylmorpholine.

A disazo pigment, in which $A_1$ and $A_2$ in formula (1) are coupler residues different from each other, is synthesized first by coupling one mole of tetrazonium salt to one mole of one of the couplers and then by coupling the tetrazonium salt to one mole of the other coupler. Alternatively, one of the amino groups of the diamine is protected by an acetyl group, diazotized and then coupled to one of the couplers. Thereafter, hydrolysis of the protected group is carried out using hydrochloric acid or the like, and that protected group is then diazotized and coupled to the other coupler.

Synthesis Example (synthesis of disazo pigment example No. 1)

A 300 ml beaker was charged with a 150 ml of water, 20 ml (0.23 mol) of thick hydrochloric acid and 8.3 g (0.032 mold) of a diamine compound expressed as follows.

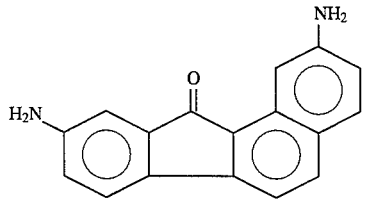

The solution was cooled down to 0° C. Thereafter, a solution obtained by dissolving 4.6 g (0.067 mol) of sodium nitride in 10 ml of water and cooled to 5° C. was dripped into the cooled solution over ten minutes. After the solution was stirred for fifteen minutes, it was carbon filtered. To this solution was added a solution obtained by dissolving 10.5 g (0.096 mol) of sodium boro-fluoride in 90 ml of water. The addition was conducted while the solution was stirred. The precipitated boro-fluoride salt was filtered and rinsed with cold water. Thereafter, the boro-fluoride salt was further scrubbed with acetonitrile, and then dried under a vacuum and at room temperature. The yield was 13.6 g, and the yield ratio was 93%.

Next, 500 ml of N,N-dimethylformamide was charged in a 1 l beaker, and 11.1 g (0.042 mol) of the coupler expressed as follows was dissolved in the N-N-dimethylformamide.

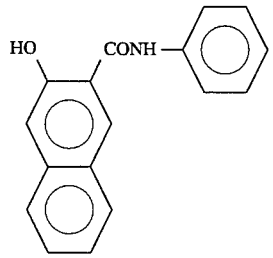

After the solution was cooled to 5° C., 9.2 g (0.020 mol) of the previously obtained boro-fluoride salt was dissolved in the cooled solution. Next, 5.1 g (0.050 mol) of triethylamine was dripped in the solution over five minutes. After the solution was stirred for two hours, the precipitated pigment was filtered. Thereafter, the pigment was scrubbed first with N-N-dimethylformamide four times and then rinsed with water three times and freeze-dried. The yield was 14.7 g, and the yield ratio was 91%. The results of the element analysis are shown as follows.

| | Calculated value (%) | Measured value (%) |
|---|---|---|
| C | 75.73 | 75.91 |
| H | 3.99 | 3.85 |
| N | 10.39 | 10.25 |

In the present invention, the photosensitive layer has any of the known configurations. However, a function separation type photosensitive layer, in which a charge transporting layer containing a charge transporting substance is disposed on a charge generating layer containing, as a charge generating substance, a disazo pigment having a benzofluorenone structure as a laminate, is desirable.

The charge generating layer can be formed either by evaporating the disazo pigment according to the present invention on a conductive substrate or by coating a solution, obtained by dispersing, together with a binder resin, the disazo pigment in an appropriate solvent, on the conductive substrate by a known method and then drying the coated solution. The charge generating layer has a thickness of 5 μm or below, more preferably, a thickness ranging from 0.1 μm to 1 μm.

The binder resin that can be used together with the disazo pigment may be an insulating resin or an organic photoconductive polymer. Examples of such resins and polymers include polyvinyl butyral, polyvinyl benzal, polyarylate, polycarbonate, polyester, phenoxy resin, cellulose resin, acrylic resin and polyurethane resin. These resins may be substituted or unsubstituted. Examples of the substituents include halogen atom, alkyl group, alkoxy group, nitro group, trifluoromethyl group and cyano group. A desirable proportion of the binder resin relative to the total amount of the charge generating layer is not greater than 70 percent by weight, more preferably, not greater than 40 percent by weight.

The solvent may be selected from substances which dissolve the binder resin but do not dissolve the charge transporting layer or an undercoating layer which will be described later. Suitable examples of such substances include ethers, such as tetrahydrofuran or 1,4-dioxane; ketones, such as cyclohexanone or methyl ethyl ketone; amides, such as N,N-dimethylformamide; esters, such as methyl acetate or ethyl acetate; aromatic hydrocarbons, such as toluene, cylene or monochlorobenzene; alcohols, such as methanol, ethanol or 2-propanol; and aliphatic hydrocarbons, such as chloroform or methylene chloride.

The charge transporting layer is laid on or under the charge generating layer, and has the function of receiving charge carriers from the charge generating layer in the presence of an electric field and transporting them onto the surface thereof. The charge transporting layer can be formed by coating a solution, obtained by dissolving a charge transporting substance in a solvent together with a binder resin when necessary, and then drying the coated solution. The charge transporting layer has a thickness ranging from 5 to 40 μm, with more preferable thickness ranging from 15 to 30 μm.

The charge transporting substance is roughly classified as an electron transporting substance or a positive hole transporting substance. Examples of electron transporting substances include: electron absorbing substances, such as 2,4,7-trinitrofluorenone, 2,4,5,7-tetranitrofluorenone, chloranyl and tetracyanoquino dimethane; and polymers of these electron absorbing substances. Examples of positive hole transporting substances include: polynuclear aromatic compounds, such as pyrene or anthracene; heterocyclic compounds, such as carbazole type compounds, indole type compounds, imidazole type compounds, oxazole type compounds, thiazole type compounds, oxadiazole type compounds, pyrazole type compounds, pyrazoline type compounds, thiadiazole type compounds or triazole type compounds; hydrazone type compounds, such as p-diethylaminobenzaldehyde-N,N-diphenylhydrazone or N,N-diphenylhydrazino-3-methylidyne-9 -ethyl carbazole; styryl type compounds, such as α-phenyl-4'-N,N-diphenylaminostilbene or 5-[4-(di-p-tolylamino)benzylidene]-5H-dibenzo [a, d]cycloheptene; benzidine type compounds; triarylmethane type compounds; triphenylamine compounds; and polymers having a group derived from any of these compounds as a principal or side chain (which may be a poly-N-vinylcarbazole or a polyvinyl anthracene). In addition to the above-described organic charge transporting substances, inorganic materials, such as selenium, selenium-tellurium, amorphous silicon or cadmium sulfide, can also be used. The above-mentioned charge transporting substances may be used either alone or in combination.

If the charge transporting substance employed is of the type which has no film forming property, an adequate binder resin may be used together with that substance. Suitable examples of such binder resin include insulating resins, such as acrylic resins, polyallylate, polyesters, polycarbonates, polystyrenes, acrylonitrile-styrene copolymers, polyacrylamides, polyamides or chlorinated rubber; and organic photoconductive polymers, such as poly-N-vinylcarbazole or polyvinel anthracene.

The electrophotographic photosensitive member according to the present invention may also be constructed such that it has a photosensitive layer containing both the disazo pigment according to the present invention and any of the above-mentioned charge transporting substances. Such an electrophotographic photosensitive member can be formed by coating a solution, obtained by dispersing and dissolving both a disazo pigment and a charge transporting substance in an adequate binder resin solution, on the conductive substrate and then drying the coated solution.

In each type of electrophotographic photosensitive member, two or more disazo pigments according to the present invention may be combined or the disazo pigment according to the present invention may be combined with any known charge generating substance.

The conductive substrate employed in the present invention may be one made of, for example, aluminum, aluminum alloy, copper, zinc, stainless steel, vanadium, molybdenum, chromium, titanium, nickel, indium, gold or platinum. The conductive substrate employed in the present invention may alternatively be that made of a plastic (which may be polyethylene, polypropylene, polyvinylchloride, polyethylene terephthalate or acrylic resin)-coated with any of the above-described metals or alloys by vacuum deposition; any of the above-described plastics, metals or alloys coated with conductive particles (which may be carbon black or silver particles) and an adequate binder resin; or plastic or paper impregnated with conductive particles. The conductive substrate employed in the present invention may have a drum-, sheet- or belt-like shape. Among these shapes, the shape which is most suited to the electrophotographic photosensitive apparatus to which the electrophotographic photosensitive member is applied is the most desirable.

In the present invention, an undercoating layer which has the barrier function and the adhesion function may be provided between the conductive substrate and the photosensitive layer. The thickness of the undercoating layer is 5 μm or below, preferably ranging from 0.1 to 3 μm. The undercoating layer may be made of, for example, casein, polyvinyl alcohol, nitrocellulose, polyamide (such as nylon 6, nylon 66, nylon 610, a copolymerized nylon or an alkoxymethyl nylon), polyurethane or aluminum oxide.

In the present invention, a resin layer or a resin layer containing conductive particles or a charge transporting substance may be provided on the photosensitive layer as a protective layer which protects the photosensitive layer from external mechanical or chemical adverse influences.

The electrophotographic photosensitive member according to the present invention can be employed not only in electrophotographic copiers but also in electrophotographic applied fields including laser beam printers, CRT printers, LED printers, liquid crystal printers, laser processes or facsimile machines.

FIG. 1 schematically shows a transfer type electrophotographic apparatus which employs the electrophotographic photosensitive member according to the present invention.

Referring to FIG. 1, a drum type electrophotographic photosensitive member 1 according to the present invention is rotatable about an axis 1*a* in the direction indicated by the arrow at a predetermined circumferential speed. During rotation, a circumferential surface of the photosensitive member is first uniformly charged to a predetermined positive or negative potential by charging means 2 and then subjected to radiation L (which may be a light obtained by slit exposure or a laser beam which scans the surface of the drum) emitted from image exposure means (not shown) to form an electrostatic latent image corresponding to the radiation L thereon. The electrostatic latent image is formed on the circumferential surface of the photosensitive member successively as the member is rotating.

The electrostatic latent image formed is developed using toner by developing means 4, and the thus-obtained toner image is successively transferred onto a transfer material P, which is fed to the space between the photosensitive member 1 and transfer means 5 from paper feeding section (not shown) synchronously with the rotation of the photosensitive member, by means of the transfer means 5.

The transfer material P onto which the toner image has been transferred is separated from the surface of the photosensitive member and then fed to a toner image fixing means 8. The transfer material P on which the toner image has been fixed is discharged to the outside of the apparatus as a copy.

The toner remaining on the surface of the photosensitive member 1, when the transfer process has been completed, is removed by cleaning means 6, and the member 1 is discharged by pre-exposure means 6 so as to prepare the photosensitive member for use in a subsequent image forming cycle.

In the present invention, a unit incorporating a plurality of components, including the electrophotographic photosensitive member 1, the charging means 2, the developing means 4 and the cleaning means 6, may be provided as a process cartridge that can be detachably mounted on an image forming apparatus body, such as a copying machine or a laser beam printer. For example, at least one component selected from a group consisting of the charging means 2, the developing means 4 and the cleaning means 6 may be combined with the photosensitive member to form a cartridge that can be mounted on and removed from the apparatus body using guiding means, such as a rail provided on the apparatus body.

In an electrophotographic apparatus which is employed as a copying machine or a printer, the radiation L may be obtained by illuminating the photosensitive member with a light reflected from or passed through an original document. The radiation L may alternatively be obtained by illuminating the photosensitive member with a light obtained by reading an original document with a sensor and by scanning a laser beam and driving an LED array or a liquid crystal shutter array according to a signal produced by the sensor.

Figure 2:
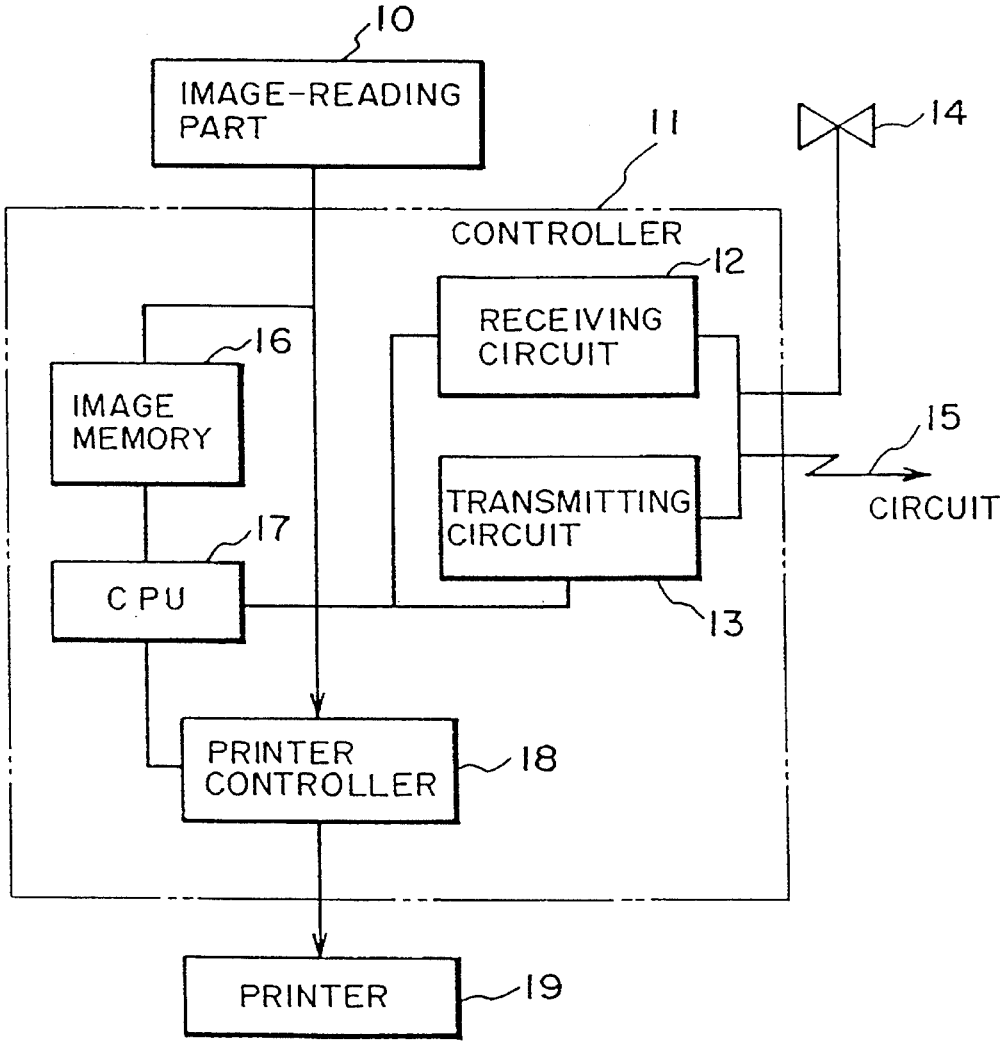
FIG. 2 is a block diagram of a facsimile machine having the electrophotographic photosensitive member according to the present invention.

In an electrophotographic apparatus employed as a printer for a facsimile machine, the radiation L is used to print out the data received by the facsimile machine. FIG. 2 is a block diagram of an electrophotographic apparatus which is used as the printer for a facsimile machine.

A controller 11 controls both an image reading unit 10 and a printer 19. The controller 11 is controlled by a CPU 17. The data read by the image reading unit 10 is transmitted to a remote terminal through a transmission circuit 13. The data received from a remote terminal is sent to the printer 19 through a receiving circuit 12. An image memory stores predetermined image data. A printer controller 18 controls the printer 19. A reference numeral 14 denotes a telephone set.

The image received through a communication line 15 (from the remote terminal connected to this facsimile machine through the communication line) is demodulated by the receiving circuit 12. The demodulated image data is decoded and stored in the image memory 16 by the CPU 17. When the image data representing one page has been stored in the image memory 16, recording of that image is performed. That is, the CPU 17 reads out the image data representing one page from the image memory 16, and sends the decoded data to the printer controller 18. Upon receipt of the image data representing the single page from the CPU 17, the printer controller 18 controls the printer 19 so that recording of the image data can be performed. The CPU 17 receives image data representing a subsequent page while the printer 19 is recording the image data.

Reception and recording of an image are thus performed.

The following examples illustrate certain preferred embodiments of the invention and are not meant to limit its scope.

EXAMPLE 1

A solution, which was prepared by dissolving, in 95 g of methanol, 5 g of methoxymethylated nylon (weight average molecular weight 32,000) and 10 g of alcohol soluble copolymer nylon (weight average molecular weight 29,000), was applied on an aluminum substrate with a wire bar, thus forming an undercoating layer of 1 μm thick after drying.

Next, 5 g of disazo pigment shown as Pigment Example 1 was added to a solution obtained by dissolving polyvinyl butyral (butyralation degree 63 mol %, weight average molecular weight 35,000) in 95 g of cyclohexanone, and dispersed for 20 hours with a sand mill. The dispersion liquid was applied on the undercoating layer with a wire bar so as to form a charge generating layer of 0.2 μm thick after drying.

Thereafter, a solution, prepared by dissolving 5 g of a hydrazone compound represented by the following formula and 5 g of polymethyl methacrylate (number average molecular weight 100,000) in 40 g of monochlorobenzene, was applied on the charge generating layer with a wire bar and dried to form a charge transporting layer of 20 μm thick after drying.

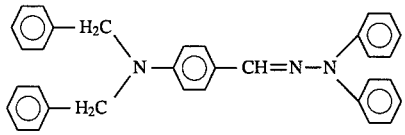

The thus-manufactured electrophotographic photosensitive member was tested using an electrostatic copying paper tester (Model SP-428, manufactured by Kawaguchi Denki Kabushiki Kaisha) to evaluate the charging characteristics thereof. In the test, the manufactured electrophotographic photosensitive member was negatively charged by −5 KV corona discharge, held in a dark place for a second, and then exposed to radiations of 10 lux emitted from a halogen lamp. Both the surface potential $V_0$ obtained immediately after charging and the exposure quantity, i.e., sensitivity, (E½) required to attenuate the surface potential obtained after being left in the dark place for a second to one half were measured as the charging characteristics. Table 1 shows the results of the measurements.

EXAMPLES 2 TO 18

Electrophotographic photosensitive members were manufactured and evaluated in the same manner as that of Example 1 with the exception that disazo pigments shown in Table 1 were used in place of the disazo pigment shown as Pigment Example 1. The results of the evaluation are also shown in Table 1.

TABLE 1

| Example No. | Pigment Example No. | $V_0$ (−V) | $E_{1/2}$(lux · sec) |
|---|---|---|---|
| 1 | 1 | 700 | 1.20 |
| 2 | 2 | 695 | 1.00 |
| 3 | 5 | 705 | 1.10 |
| 4 | 6 | 698 | 1.05 |
| 5 | 9 | 700 | 0.85 |
| 6 | 10 | 703 | 1.10 |
| 7 | 14 | 698 | 1.20 |
| 8 | 15 | 699 | 0.93 |
| 9 | 18 | 702 | 1.00 |
| 10 | 21 | 700 | 0.98 |
| 11 | 24 | 698 | 1.13 |
| 12 | 30 | 697 | 1.35 |
| 13 | 32 | 700 | 1.07 |
| 14 | 37 | 702 | 0.88 |
| 15 | 42 | 693 | 0.98 |
| 16 | 50 | 705 | 1.13 |
| 17 | 57 | 703 | 1.25 |
| 18 | 60 | 702 | 1.18 |

Comparative Examples 1 to 6

Using the following Comparative pigments A to F, electrophotographic photosensitive members were manufactured in the same process as that of Example 1. The manufactured members were evaluated in the same manner as that of Example 1. The results of the evaluation are shown in Table 2.

Comparative Pigment A
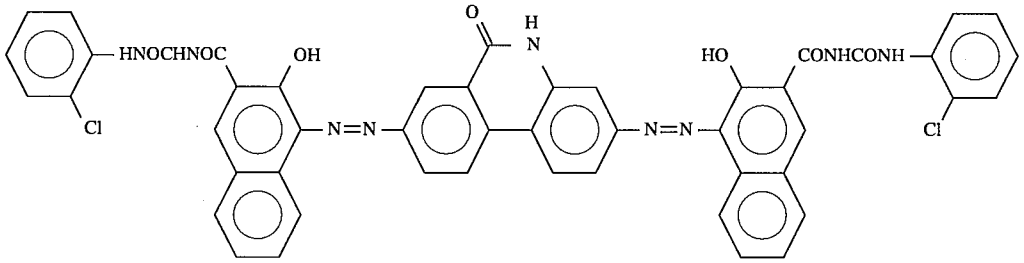
Comparative Pigment B
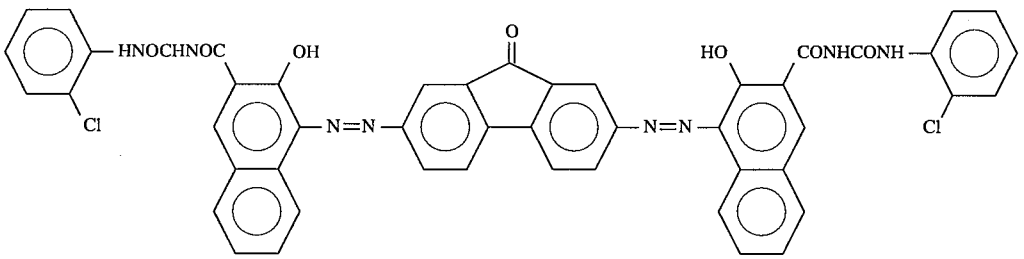
Comparative Pigment C
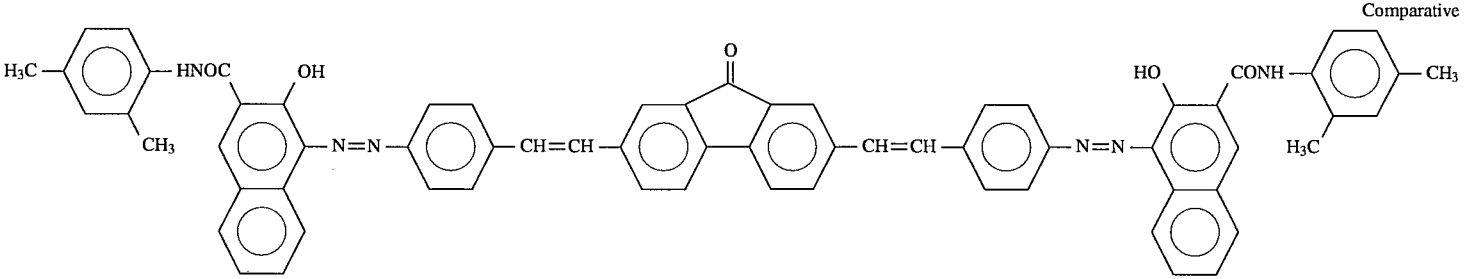

-continued
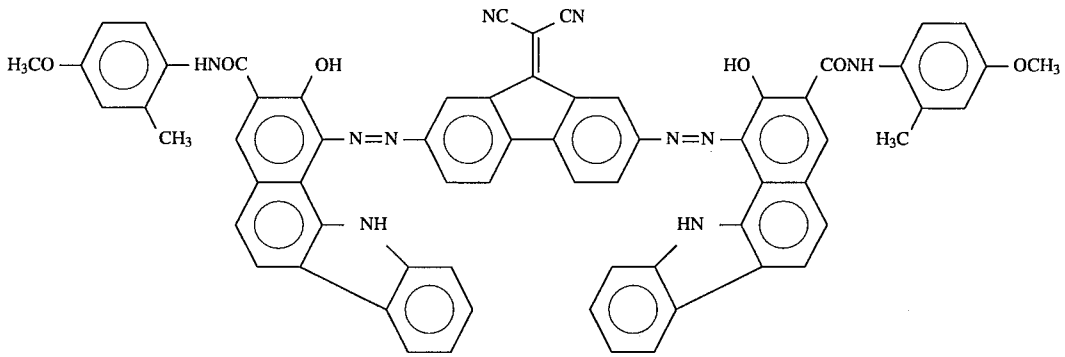
Comparative Pigment D
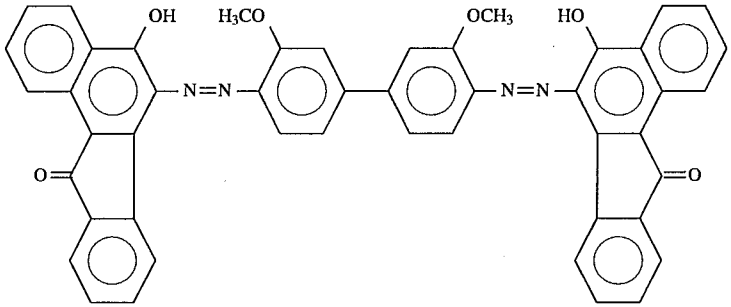
Comparative Pigment E
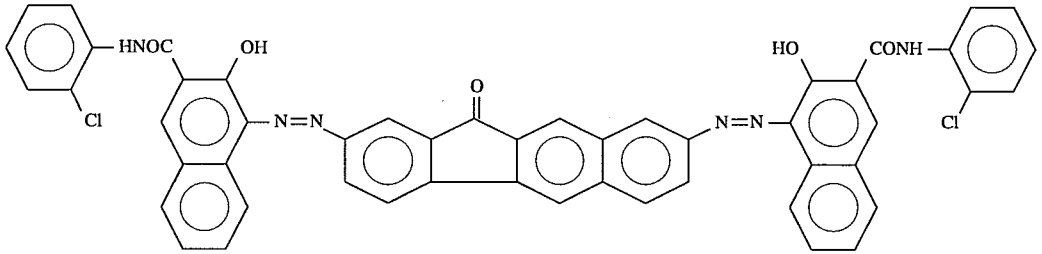
Comparative Pigment F

TABLE 2

| Comparative Example No. | Comparative Pigment No. | $V_0$ (−V) | $E_{1/2}$ (lux · sec) |
|---|---|---|---|
| 1 | A | 695 | 9.2 |
| 2 | B | 692 | 3.5 |
| 3 | C | 691 | 5.8 |
| 4 | D | 695 | 3.8 |
| 5 | E | 690 | 2.7 |
| 6 | F | 700 | 3.8 |

It can be seen from the above results that the electrophotographic photosensitive members according to the present invention have a sufficient charging ability and excellent sensitivity.

EXAMPLES 19 TO 30

The electrophotographic photosensitive member manufactured in Example 1 was adhered to a cylinder of an electrophotographic copying machine having a −6.5 KV corona charger, an exposure optical system, a developing unit, a transfer charger, a charge-removing optical system and a cleaner.

After an initial dark part potential $V_D$ and an initial light part potential $V_L$ were set to about −700 V and −200 V, respectively, the apparatus was used 5,000 times. A change $\Delta V_D$ in the dark part potential from the initial value and a change $\Delta V_L$ in the light part potential from the initial value were measured. The results are shown in Table 3. A negative sign placed in front of the change in the potential indicates that the absolute value of the potential has decreased, and a positive sign shows that the absolute value of the potential has increased.

The same evaluation was conducted on the electrophotographic photosensitive members manufactured in Examples 2, 3, 4, 5, 8, 10, 12, 14, 16, 17 and 18. The results of the evaluations are shown in Table 3.

TABLE 3

| Example No. | $\Delta V_D$ (V) | $\Delta V_L$ (V) |
|---|---|---|
| 19 | +5 | +5 |
| 20 | +5 | +5 |
| 21 | 0 | −5 |
| 22 | +5 | +5 |
| 23 | −5 | −5 |
| 24 | −5 | −5 |
| 25 | −5 | +5 |
| 26 | −10 | +5 |
| 27 | 0 | +5 |
| 28 | 0 | −5 |
| 29 | −10 | +5 |
| 30 | −5 | +5 |

Comparative Examples 7 to 12

The same evaluation as that in Example 19 was conducted on the electrophotographic photosensitive members manufactured in Comparative Examples 1 to 6. The results are shown in Table 4.

TABLE 4

| Comparative Example No. | $\Delta V_D$ (V) | $\Delta V_L$ (V) |
|---|---|---|
| 7 | −70 | +90 |
| 8 | −60 | +55 |
| 9 | −100 | +60 |
| 10 | −80 | +80 |
| 11 | +25 | +35 |
| 12 | −60 | +30 |

It is apparent from the results of Examples 19 to 30 and those of Comparative Examples 5 to 8 that in the present invention change in the potential of the electrophotographic photosensitive member after repeated use is smaller than that in the Comparative Examples.

EXAMPLE 31

An undercoating layer of polyvinyl alcohol was formed on an aluminum surface of an aluminum deposited polyethylene terephthalate film to a 0.5 μm thickness. A 0.2 μm-thick charge generating layer was formed by coating the same dispersion liquid as the disazo pigment dispersion liquid employed in Example 2 on the undercoating layer with a wire bar and by drying the coated dispersion liquid. Next, a 20 μm-thick charge transporting layer was formed by coating, on the charge generating layer, a solution obtained by dissolving 5 g of a styryl compound expressed by the following formula and 5 g of polycarbonate (weight average molecular weight 55,000) in 40 g of tetrahydrofuran, and then by drying the coated solution.

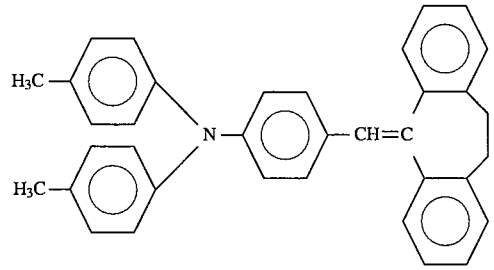

The charging characteristics and durability of the thus-manufactured electrophotographic photosensitive members were evaluated in the same manner as that of Examples 1 and 19. The results are as follows:

$V_0$: −700 V, $E_{1/2}$: 0.85 lux.sec $\Delta V_D$: +5 V, $\Delta V_L$: +5 V

EXAMPLE 32

A 0.5 μm-thick undercoating layer was formed on an aluminum surface of an aluminum deposited polyethylene terephthalate film. A 0.2 μm-thick charge generating layer was formed by applying the same dispersion liquid as the disazo pigment dispersion liquid employed in Example 5 on the undercoating layer with a wire bar and then by drying the applied dispersion liquid. Next, a 20 μm-thick charge transporting layer was formed by coating, on the charge generating layer, a solution obtained by dissolving 5 g of a triarylamine compound represented by the following formula and 5 g of polycarbonate (weight average molecular weight 55,000) in 40 g of tetrahydrofuran, and then by drying the coated solution.

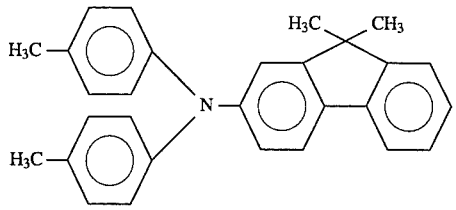

The charging characteristics and durability of the thus-manufactured electrophotographic photosensitive members were evaluated in the same manner as that of Examples 1 and 19. The results are as follows:

$V_0$: −705 V, $E_{1/2}$: 0.83 lux.sec $\Delta V_D$: 0 V, $\Delta V_L$: +5 V

EXAMPLE 33

An electrophotographic photosensitive member was manufactured in the same manner as that of Example 8 with the exception that the order in which the charge generating layer and the charge transporting layer were formed was reversed from that of Example 8. The same evaluation as that of Example 1 was conducted on the manufactured member. However, in this example, the member was positively charged. The results are as follows:

$V_0$: +700 V, $E_{1/2}$: 1.53 lux.sec

EXAMPLE 34

An undercoating layer and an charge generating layer were formed in the same manner as that of Example 14. A 18 μm-thick charge transporting layer was formed by applying a solution, obtained by dissolving 5 g of 2,4,7-trinitro-9-fluorenone and 5 g of polycarbonate (weight average molecular weight 30,000) in 50 g of tetrahydrofuran, on the charge generating layer with a wire bar and then by drying the applied solution. The same evaluation as that of Example 1 was conducted on the manufactured member. However, the member was charged positively in this example. The results are shown as follows:

$V_0$: +695 V, $E_{1/2}$: 1.72 lux.sec

EXAMPLE 35

0.5 g of disazo pigment shown as Pigment Example No. 58 was dispersed in 9.5 g of cyclohexanone for five hours using a paint shaker. After a solution obtained by dissolving 5 g of the charge transporting substance used in Example 1 and 5 g of polycarbonate (weight average molecular weight 70,000) in 40 g of tetrahydrofuran was added to the dispersion liquid, the mixture was shaken for another hour. A 20 μm-thick photosensitive layer was formed by applying the thus-obtained solution on an aluminum substrate with a wire bar and then by drying the applied solution. The same evaluation in that of Example 1 was conducted on the manufactured member. However, the member was charged positively in this example. The results are shown as follows:

$V_0$: +700 V, $E_{1/2}$: 1.65 lux.sec

While the present invention has been described with respect to what is presently considered to be the preferred embodiments, it is to be understood that the invention is not limited to the disclosed embodiments. To the contrary, the invention is intended to cover various modifications and equivalent formulations included within the spirit and scope of the appended claims. The scope of the following claims is to be accorded the broadest interpretation so as to encompass all such modifications and equivalent formulations.

What is claimed is:

1. An electrophotographic photosensitive member comprising: a conductive substrate and a photosensitive layer thereon, said photosensitive layer containing a disazo pigment having a 1,2-benzofluorenone as a central structure.

2. An electrophotograph photosensitive member according to claim 1, wherein said disazo pigment has the following formula (1):

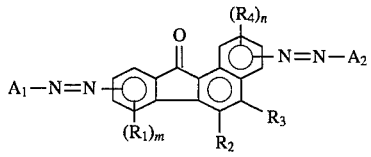

(1)

wherein $A_1$ and $A_2$ are the same or different and are each a coupler residue having a phenolic hydroxyl group; $R_1$, $R_2$, $R_3$, and $R_4$ are the same or different and are each a hydrogen atom, a halogen atom, an alkyl group or an alkoxy group; and m and n represent 1, 2 or 3.

3. An electrophotographic photosensitive member according to claim 2, wherein $A_1$ and $A_1$ are each independently a coupler residue having a formula selected from the group consisting of the following formulas:

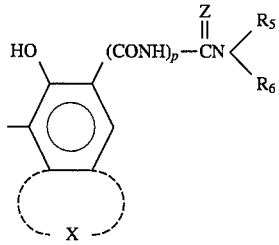

(2)

wherein X is a residue forming a polycyclic aromatic ring or a heterocyclic ring with a benzene ring; $R_5$ and $R_6$ are the same or different and are each a hydrogen atom, an alkyl group, an aryl group, an aralkyl group, a heterocyclic group, or $R_5$ and $R_6$ are bonded together to form a cyclic amino group; Z is an oxygen atom or a sulfur atom; and p is 0 or 1;

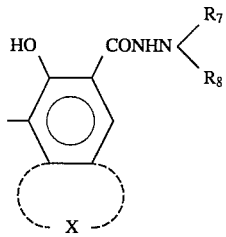

(3)

wherein X is a residue forming a polycyclic aromatic ring or a heterocyclic ring with a benzene ring; and $R_7$ and $R_8$ are the same or different and each are a hydrogen atom, an alkyl group, an aryl group, an aralkyl group, a heterocyclic group, or are bonded together to form a cyclic amino group;

(4)

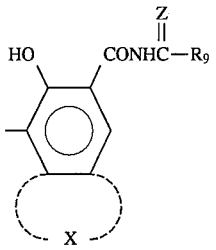

wherein X is a residue forming a polycyclic aromatic ring or a heterocyclic ring with a benzene ring; $R_9$ is a hydrogen atom, an alkyl group, an aryl group, an aralkyl group or a heterocyclic group; and Z is an oxygen atom or a sulfur atom;

(5)

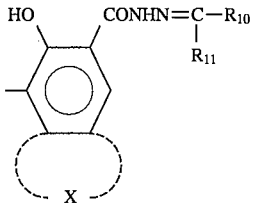

wherein X is a residue forming a polycyclic aromatic ring or a heterocyclic ring with a benzene ring; and $R_{10}$ and $R_{11}$ are the same or different and are each a hydrogen atom, an alkyl group, an aryl group, an aralkyl group or a heterocyclic group;

(6)

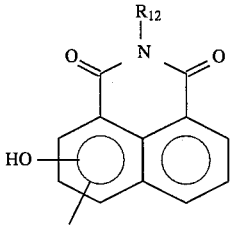

wherein $R_{12}$ is an alkyl group, an aryl group, an aralkyl group or a heterocyclic group; and (7)

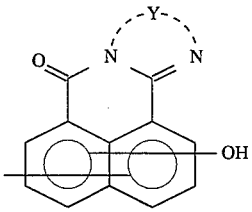

wherein Y is either an arylene group or a bivalent heterocyclic group.

4. An electrophotographic photosensitive member according to claim 3, wherein $A_1$ and $A_2$ are each independently a coupler residue having a formula selected from the group consisting of said formulas (2) to (5) wherein X forms a benzocarbazole ring with a benzene ring.

5. An electrophotographic photosensitive member according to claims 2 or 3, wherein $R_1$, $R_2$, $R_3$, and $R_4$ are each a hydrogen atom.

6. An electrophotographic photosensitive member according to claims 1 or 2, wherein said electrophotographic photosensitive member comprises a charge generating layer containing said disazo pigment as a charge generating substance on said conductive substrate and a charge transporting layer on said charge generating layer.

7. A process cartridge, comprising: an electrophotographic photosensitive member and at least one means selected from the group consisting of charging means, developing means and cleaning means;

said electrophotographic photosensitive member comprising a conductive substrate and a photosensitive layer thereon, said photosensitive layer containing a disazo pigment having a 1,2-benzofluorenone as a central structure;

said electrophotographic photosensitive member and said at least one means are supported as a single unit which is detachably mounted on an electrophotographic apparatus body.

8. A process cartridge according to claim 7, wherein said disazo pigment has the following formula (1):

(1)

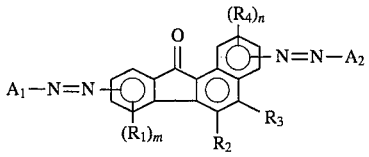

wherein $A_1$ and $A_2$ are the same or different and are each a coupler residue having a phenolic hydroxyl group; $R_1$, $R_2$, $R_3$, and $R_4$ are the same or different and are each a hydrogen atom, a halogen atom, an alkyl group or an alkoxy group; and m and n represent 1, 2 or 3.

9. An electrophotographic apparatus, comprising: an electrophotographic photosensitive member, a charging means, an image exposure means, a developing means and a transfer means;

said electrophotographic photosensitive member comprising a conductive substrate and a photosensitive layer thereon, said photosensitive layer containing a disazo pigment having a 1,2-benzofluorenone as a central structure.

10. An electrophotographic apparatus according to claim 9, wherein said disazo pigment has the following formula (1):

(1)

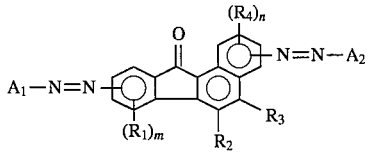

wherein $A_1$ and $A_2$ are the same or different and are each a coupler residue having a phenolic hydroxyl group; $R_1$, $R_2$, $R_3$, and $R_4$ are the same or different and are each a hydrogen atom, a halogen atom, an alkyl group or an alkoxy group; and m and n represent 1, 2 or 3.

* * * * *

UNITED STATES PATENT AND TRADEMARK OFFICE

CERTIFICATE OF CORRECTION

PATENT NO. : 5,527,653

DATED : June 18, 1996

INVENTOR(S) : Masato Tanaka

It is certified that error appears in the above-identified patent and that said Letters Patent is hereby corrected as shown below:

Title page, item [21],

"Appln. No.: 314,768" should read --Appln. No. 314,769--.

ABSTRACT

Line 6, "is" should read --are--.

COLUMN 4

Line 5, "Such" should read --such--.

COLUMN 33

Line 11, "mold)" should read --mol)--.

COLUMN 35

Line 20, "polyvinel" should read --polyvinyl--.
Line 43, "resin)-coated" should read --resin) coated--.

UNITED STATES PATENT AND TRADEMARK OFFICE

CERTIFICATE OF CORRECTION

PATENT NO. : 5,527,653

DATED : June 18, 1996

INVENTOR(S) : Masato Tanaka

It is certified that error appears in the above-identified patent and that said Letters Patent is hereby corrected as shown below:

COLUMN 46

Line 12, "electrophotograph" should read --electrophotographic--.
Line 30, "$A_1$ and $A_1$" should read --$A_1$ and $A_2$--.

Signed and Sealed this

Twenty-sixth Day of November 1996

*Attest:*

*Attesting Officer*

BRUCE LEHMAN

*Commissioner of Patents and Trademarks*